US008456322B2

(12) United States Patent
Marquardt et al.

(10) Patent No.: US 8,456,322 B2
(45) **Date of Patent: *Jun. 4, 2013**

(54) WARNING LIGHT DEVICE HAVING AT LEAST TWO WARNING LAMPS

(75) Inventors: Juergen Marquardt, Rietheim-Weilheim (DE); Daniel Kensy, Wurmlingen (DE)

(73) Assignee: WERMA Holding GmbH + Co. KG, Rietheim-Weilheim (DE)

( * ) Notice: Subject to any disclaimer, the term of this patent is extended or adjusted under 35 U.S.C. 154(b) by 628 days.

This patent is subject to a terminal disclaimer.

(21) Appl. No.: 12/588,969

(22) Filed: Nov. 4, 2009

(65) Prior Publication Data

US 2010/0109900 A1 May 6, 2010

(30) Foreign Application Priority Data

Nov. 4, 2008 (DE) ..... 10 2008 055 799

(51) Int. Cl.
*G08B 5/36* (2006.01)

(52) U.S. Cl.
USPC ..... 340/815.73; 340/815.4; 340/332

(58) Field of Classification Search
USPC ..... 340/815.73, 332, 572.5, 815.4, 815.45, 340/815.65, 815.69, 635; 362/555, 583, 559; 345/46, 82, 83, 84
See application file for complete search history.

(56) References Cited

U.S. PATENT DOCUMENTS

| | | | | |
|---|---|---|---|---|
| 7,587,178 | B2 * | 9/2009 | Marquardt | 455/90.3 |
| 7,999,693 | B2 * | 8/2011 | Hohler | 340/815.4 |
| 2005/0200460 | A1 | 9/2005 | Marquardt | |

FOREIGN PATENT DOCUMENTS

| | | | |
|---|---|---|---|
| DE | 195 13 983 | A1 | 10/1995 |
| DE | 296 07 402 | U1 | 6/1996 |
| DE | 100 58 695 | B4 | 5/2002 |
| DE | 101 24 132 | A1 | 2/2003 |
| DE | 10 2005 014 345 | A1 | 10/2006 |
| EP | 1 650 489 | A2 | 4/2006 |
| EP | 1 650 721 | A1 | 4/2006 |

* cited by examiner

*Primary Examiner* — Toan N Pham
(74) *Attorney, Agent, or Firm* — Breneman & Georges

(57) ABSTRACT

A warning light device having a first warning lamp exhibiting at least one first light unit with at least one first lighting element for visually indicating at least one operating state of a first technical unit having a first electronic control device and having at least one indicating unit for visually indicating at least one operating state, especially several different operating states of the first warning lamp, wherein at least one electronic warning lamp connection is provided for transmitting data and/or control signals at least between the first warning lamp and the indicating unit to provide for the monitoring of several different technical units with considerably less expenditure than in the prior art. This is achieved by the fact the indicating unit is constructed as signaling column having at least one second alternating module with at least one second lighting element.

17 Claims, 3 Drawing Sheets

WARNING LIGHT DEVICE HAVING AT LEAST TWO WARNING LAMPS

CROSS REFERENCE TO RELATED APPLICATIONS

Figure 1:
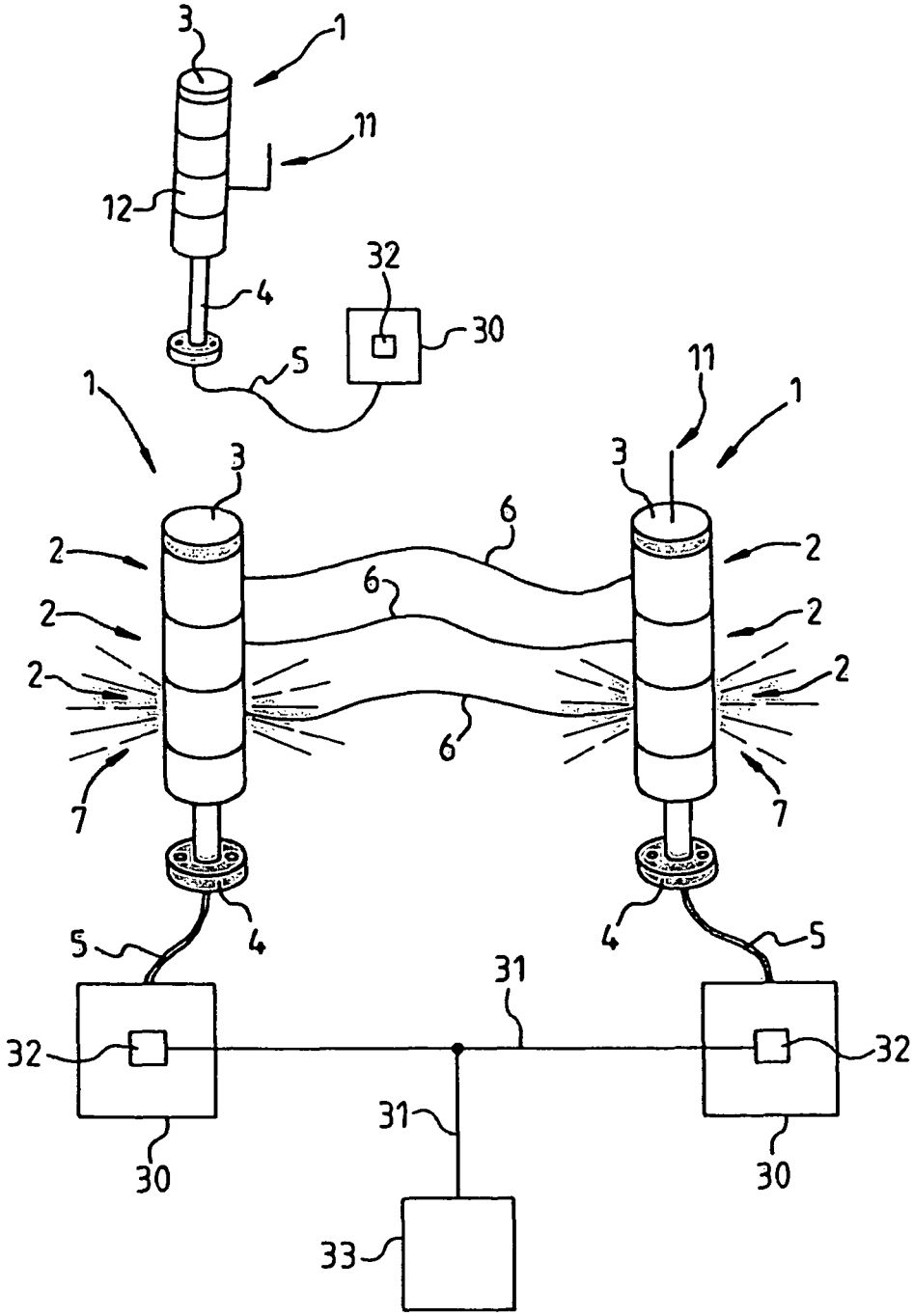

The subject matter of this application is related to U.S. application Ser. No. 12/588,970, filed Nov. 4, 2009 and titled, Warning Light Device Having At Least Two Warning Lamps.

BACKGROUND OF THE INVENTION (1) Field of the Invention

The invention relates to a warning light device having a first warning lamp exhibiting at least one first light unit comprising at least one first lighting element for visually indicating at least one operating state, especially several different operating states, of a first technical unit such as a machine, a plant, a vehicle or the like, and having at least one second corresponding warning lamp.

(2) Description of Related Art Including Information Disclosed Under 37 C.F.R. 1.97 And 1.98

From DE 19 513 983 A1 of the applicant, for example, a signaling column having a number of alternating modules is already known, a bayonet locking arrangement being provided for mechanically and electrically connecting the individual alternating modules with one another. In this arrangement, the electrical contacting is already realized with the assembly of the alternating modules.

In general, such alternating modules have different colors within a signaling column. The color combination of traffic lights is frequently selected where, for example, the color green stands for faultless operation, the color red stands for danger or for a shutdown of the machine, etc.

Each alternating module has an incandescent lamp or one or several light-emitting diodes which are already colored correspondingly or which generate white light and the correspondingly colored [ ]culotte specifies the desired luminous color of the alternating module.

In practice it has been found that the operating state of the technical unit to be monitored can be of interest not only to the operating person on site but possibly also to the foreman or to a leading person or to an operating person who is not always on site at the technical unit. Correspondingly, corresponding alternating modules or signaling columns which convey the operating states of the technical unit or the operating state of the warning lamp, for example by means of a corresponding SMS or the like, via a wireless communication, e.g. to a mobile of the operating person, are already known, for example, from printed documents DE 100 58 695 or DE 10 2004 0123 09 A1.

Although such remote monitoring of the warning light column has improved the practical operation or the monitoring of the technical unit, respectively, it has also been found that this is possible only to a limited extent especially in large workshops having a number of or numerous technical machines to be monitored and having corresponding signaling columns, or the ability of allocating the indicated operating states is impaired. However, since it is frequently a matter of safety-related monitoring functions which must be fulfilled by the signaling columns or the warning lamps, this represents a considerable safety risk in the monitoring of several technical units or warning lamps. Thus, a network having a number of machines which in each case have a signaling column is already known from DE 101 24 132 A1, the signaling columns being linked into the network via the common transmission path of the machines. By this means, the operating states of the signaling columns can be indicated centrally by means of a computer or screen.

The disadvantageous factor in this arrangement is, however, that the network consisting of production machines, signaling columns and screens must have a uniform control or communication system. In practice, however, apart from machines networked together, there are frequently also individual machines and/or machines or groups of machines having different incompatible bus systems. In relatively large plants with a long history in some cases, especially, machines from different decades or generations are used. In some cases, these cannot be networked together in order to be able to implement, for example, central monitoring of the operating states, or can be networked together only with considerable technical or electronic complexity, in order to be able to implement, for example, central monitoring of the operating states of the machines according to DE 101 24 132 A1.

BRIEF SUMMARY OF THE INVENTION

By comparison, it is the object of the invention to provide a warning light device having at least two warning lamps in which arrangement, above all, the monitoring of several different technical units can be implemented with considerably less complexity than in the case of the prior art.

Starting with a warning light device of the type initially mentioned, this object is achieved by providing an indicating unit constructed as a signaling column having at least one second alternating module comprising at least one second lighting element. Additional measures provide for advantageous embodiments and developments of the invention include having at least one second warning lamp exhibiting at least one second light unit comprising at least one second lighting element for visually indicating at least one operating state, especially several different operating states of a second technical unit such as a machine a plant, a vehicle or the like wherein the indicating unit is constructed for visually indicating at least one operating state, especially of several different operating states at least of the first and second warning lamp, by having a third warning lamp exhibiting at least one third light unit comprising at least one third lighting element for visually indicating at least one operating state, especially several different operating states of a third technical unit such as a machine, a plant a vehicle or the like wherein the indicating unit is constructed for visually indicating at least one operating state, especially several different operating states at least of the first and the second and the third warning lamp, by having the signalling column exhibit several alternating modules which in each case comprising at least one module lighting element, by having a number of alternating modules comprising a lighting element of the signaling column that corresponds to the number of light units of the first and/or second and/or of the third warning lamp, by having the number of alternating modules of the signaling column correspond to the number of warning lights by, having at least some of the technical units to be monitored exhibit at least one control device and/or in that at least one electronic unit connection is provided for transmitting data and/or control signals between technical units to be monitored, by having an electronic warning lamp connection constructed separately from electronic control devices of technical units to be monitored and/or separately from the electronic unit connection, by having an electronic warning lamp connection comprising at least one transmitter and/or receiver for the wireless control signal and/or data transmission, by having at least one address and/or code allocated to each of the warning lamps and/or of the signaling columns and/or of the alternating modules, by having at least one electrical data memory for storing the operating states of at least one of the warning lamps and/or of the light units and/or of the signaling columns and/or of the alternating modules and by having at least one display unit for visually indicating the operating states of at least one of the warning lamps and/or of the light units and/or of the signaling columns and/or of the alternating modules.

Correspondingly, a warning light device according to the invention, having at least two warning lamps, is characterized by the fact that the indicating unit is constructed as signaling column having at least one second alternating module comprising at least one second lighting element or module lighting element, respectively. Compared with a screen as indicating unit according to the prior art, an indicating unit constructed as signaling column can be produced with much less expenditure and is distinctly more cost effective and can be integrated better in a signaling column system/network.

With the aid of the present invention, it is possible to adopt the indicating principle of warning lamps which are frequently also constructed as signaling columns for the indicating column, especially for the central component. This improves the operational reliability of the warning device according to the invention since the operating person only needs to know one uniform warning indication system which avoids possible confusion.

By this means, it is also achieved that the signaling column used as indicating unit can be positioned at a prominent location which is largely independent of the warning lamps so that the monitoring person can observe the operating states of the warning lamps especially well and from a central position. In this context, the signaling column advantageously exhibits several alternating modules comprising in each case at least one module lighting element.

In a special development of the invention, at least one second and/or third warning lamp exhibiting at least one second and/or third light unit comprising at least one second and/or third lighting element is provided for visually indicating at least one operating state, especially several different operating states, of a second technical unit such as a machine, a plant, a vehicle or the like and, in addition, the indicating unit is constructed for visually indicating at least one operating state, especially several different operating states, at least of the first and the second and/or third warning lamp.

Preferably, the second and/or third warning lamp can be or is constructed as the first technical unit or as the indicating unit according to the invention, respectively, and in addition, at least one electronic connection is provided for transmitting data and/or control signals between at least two warning lamps and the indicating unit. By this means, the first warning lamp, as indicating unit according to the invention, can visually indicate the operating state/states of the second warning lamp.

According to the invention, the signaling column constructed as indicating unit can copy the warning lamps or indicate or copy at least one operating state of the other warning lamps with the aid of the advantageous electronic connection.

BRIEF DESCRIPTION OF THE SEVERAL VIEWS OF THE DRAWING(S)

Preferably, when using at least three or more warning lamps within a warning light device or a warning lamp system/combination, each warning lamp can copy at least one of the or essentially all other warning lamps or indicate their operating states, respectively. By this means, it is achieved that, for example, it is possible to select with the aid of an advantageous selecting device which warning lamp or its operating states is/are to be indicated by a particular warning lamp. This means that, for example at a first warning lamp, an operating person would like to represent or have indicated the operating state of a third warning lamp which is further distant or removed. With the aid of the invention and possibly an advantageous selecting device, this person selects, for example, the third warning lamp so that, in this exemplary case, the first warning lamp then preferably indicates the current operating state of the third warning lamp. This can be implemented correspondingly for the other warning lamps present within the warning light system.

According to the invention, it is thus possible that a single operating person at a particular location or in the area of a single warning lamp or the signaling column constructed as indicating unit, respectively, can also monitor without great effort the other warning lamps and thus the operating states of the other technical devices to be monitored such as, for example, CNC machine tools, printing machines, conveyor belts etc.

It is a particular advantage of the invention that, for example, the most varied devices such as machine tools, vehicles or the like having in each case the most varied electronics or control or operating systems, can be monitored jointly or in a centralized manner by means of the warning light device according to the invention. In this context, the common electronic system or the common control system of the warning lamps is advantageously used.

In large production sites or industrial factories, it is common, for example, that machines, e.g. from the middle of the last century with a retrofitted or subsequently installed electronic control can be found as can machines from the end of the last century with a special electronic control bus and also the most recent highly complex machines with novel bus systems which can be operated in an automated manner. The invention preferably does not access the most varied controls or bus systems etc. of these most varied machines but accesses the warning lamps and, according to the invention, connects these advantageously. Correspondingly, an elaborate or partially almost unrealizable connection of the most varied machines by means of complex interfaces or the like is rendered unnecessary with the aid of the invention.

In consequence, according to the invention, networking of the most varied technical units can be implemented without great expenditure with the aid of the advantageous warning light device. This represents a considerable improvement in the monitoring of several technical units or several warning lamps, respectively, which mainly also leads to a decisive increase in operational reliability of the technical units to be monitored.

Apart from the selecting device described above, for selecting the respective warning lamp or the signaling column constructed as indicating unit, the operating state of which is to be indicated by a particular warning lamp, it is additionally also conceivable that, for example, periodic processing or a temporally successively specified indication of the respective warning lamps integrated in the warning light device could be provided. In this arrangement, for example, an advantageous, possibly separate indicating element such as, for example, a separate alternating module and/or a numerical indicator etc. can also be provided by means of which the respective operating person detects which warning lamp is currently indicated or copied by the corresponding warning lamp.

As an alternative or in combination herewith, for the copying of a warning lamp by a particular or the signaling column constructed as indicating unit, respectively, a special warning lamp can also be provided which, for example, indicates a special operating state of the other warning lamps and thus of the technical unit. This can mean, e.g., that, for example, the signaling column constructed as indicating unit, in an advantageous embodiment of the invention, has several light units having essentially the same color, for example red light units. By this means, the signaling column constructed as indicating unit can mainly indicate the "red" or especially critical operating states of the other warning lamps.

Among other things, it is conceivable that in a warning light device according to the invention having a total of six warning lamps, a signaling column according to the invention here called the central warning lamp exhibits, for example, five red light units, e.g. the first light unit from the bottom being allocated to the first further warning lamp and being illuminated if the corresponding red light unit is illuminated in the first further warning lamp. This correspondingly applies to the second light unit from the bottom of the central warning lamp for the second warning lamp and also to the third light unit of the central warning lamp for the third warning lamp etc. In this embodiment, for example, no above-mentioned selecting device for selecting the respective other warning lamps is necessary.

It is a special advantage of such a central warning lamp or the signaling column constructed as indicating unit according to the invention, respectively, that it can be positioned at a special location, for example in the entrance area of a workshop and/or within visual range of the or at the workshop manager, foreman or the like. By this means, the (special) operating states of the other warning lamps can be monitored and detected centrally with the aid of the advantageous first warning lamp or central warning lamp.

In the aforementioned illustrative embodiment, the number of light units of the signaling column constructed as indicating unit or of the central warning lamp advantageously essentially corresponds to the number of further warning lamps.

In the illustrative embodiment represented above, where the signaling column constructed as indicating unit largely copies the other further warning lamps or each warning lamp within the warning light device can largely copy the respective other warning lamp, the number of light units of the signaling column according to the invention or the number of light units of all warning lamps is advantageously essentially equal.

The connection preferably comprises an electrical connecting cable. Connecting the existing warning lamps with the aid of a connecting cable is comparatively simple and can be achieved cost-effectively. For example, a control unit of the signaling column constructed as indicating unit can be connected to a control unit of the warning lamps in an advantageous manner.

As an alternative or in combination herewith, the individual light units of the different warning lamps can also be advantageously connected to one another, especially by means of a connecting cable.

With the aid of the abovementioned exemplary embodiments, a connection can be achieved wherein in each case several light units or warning lamps are electrically interconnected with one another in a common circuit. The light units/alternating modules are preferably electrically interconnected with one another in parallel.

With such an advantageous electrical interconnection, simple copying or transmission of the operating states of a particular warning lamp to another warning lamp and/or the central warning lamp can be achieved.

The connection advantageously comprises at least one transmitter and/or receiver for the wireless data transmission between at least two warning lamps/signaling columns. With the aid of such a radio connection between two warning lamps/signaling columns, a particularly flexible connection is possible. In this arrangement, no cables are run between corresponding warning lamps or light units etc.

It is especially the subsequent installation of the invention in a workshop with several technical units or machines which are to be monitored with warning lamps/signaling columns according to the invention or warning light device according to the invention which can be advantageously achieved with the aid of this wireless connection.

In a special development of the invention, the or each light unit/alternating module comprises at least one control unit for controlling the operating state of the light unit, with an addressable interface to a digital data transmission unit. The result of this measure is that the light unit is illuminated not as has hitherto been generally the case when electrical power is applied to its power supply device but when the digital data transmission unit transmits addressed data or data with a corresponding address of the light unit to the addressable interface of the light unit. Correspondingly, the interface advantageously switches or connects the electrical power to the lighting element/elements with a correspondingly transmitted or correct address. Correspondingly, a transmission of information takes place which is separate from the power supply. In this context, two power conductor elements or electrical supply cables or the like are now adequate for supplying the one light unit or several or numerous light units with power.

Advantageously, several light units/alternating modules according to the invention are serially interconnected with respect to the power supply or a single circuit is provided for one or more light units. The operation of the light unit or the illumination of the light unit is achieved by the addressing. This means that, for example, in the case of several, e.g. eight light units/alternating modules, a particular light unit is illuminated when the associated address which is transmitted to the addressable interface by means of the digital data transmission unit and corresponds to an advantageously specified address of the particular interface or light unit. Correspondingly, the interface switches or connects the lighting element of the light unit to the power supply.

In the case where the address transmitted by means of the data transmission unit does not correspond to the specified address of the light unit/alternating module, the interface of the corresponding light unit will not switch. This means no connection will be established between the lighting element and the power supply.

In a special development of the invention, at least one address and/or one code is essentially allocated to each of the warning lamps/signaling columns and/or the light units/alternating modules. With the aid of such addressing or codification of the individual warning lamps/light units present in the warning light device, an unambiguous and advantageous allocation can be realized. This is of special advantage especially in the case of a wireless data transmission between the warning lamps.

According to the invention, for example, an addressing of the light units can be achieved in that, for example, an at least two-digit number or codification is implemented wherein, e.g., the first digit designates the respective warning lamp and the second digit designates the number of the respective light unit of this warning lamp. Alternative addressings or codification are also conceivable.

In an advantageous variant of the invention, at least one electrical data memory is provided for storing the operating states of at least one of the warning lamps/signaling columns and/or of the light units. With the aid of such an advantageous data memory, for example, statistical evaluations can be advantageously achieved, among other things, for a particular operating period such as, for example, one month or one year. For example, downtimes of the technical units to be monitored can be correspondingly calculated or determined. In this context, the operating states stored can be advantageously added together or accumulated and, in particular, represented.

Preferably, at least one display unit is provided for visually indicating the operating states of at least one of the warning lamps/signaling columns and/or of the light units. In particular, the display unit is constructed as a screen. With the aid of such an advantageous visual representation, completely new possibilities of central monitoring or remote monitoring of several warning lamps are obtained.

Moreover, it is possible to implement the most varied visual representations of the stored operating states or statistically evaluated operating states especially also by means of the display unit, in the most varied manner, e.g. as pie/bar charts etc.

The display unit is preferably constructed for indicating all warning lamps/signaling columns and/or light units and/or connections. This advantageously provides for overall monitoring of all components or warning lamps/light units involved. This is of special advantage especially for a plant manager, foreman, business manager or the like in order to centrally or jointly detect, for example, the individual warning lamps and thus the individual technical units such as machines, particularly machine tools or the like, possibly viewing or controlling these offset in time with the aid of the advantageous storage and/or carrying out statistical calculations and representing these advantageously. This makes it possible in a novel manner to achieve an optimization of the operation of the technical units to be monitored.

For the indication or storage and calculation of statistical evaluations or the like, the computer, preferably a Notebook, a so-called PDA but also a mobile or other portable electronic media, in particular, are of special advantage.

The electronic connection according to the invention comprises these electronic devices particularly when computers, Notebooks, PDAs or the like are used. For example, such electronic devices are linked or integrated into the warning light device via advantageous or commercially available interfaces. In this context, for example, so-called bus systems can be used such as, for example, USB, RS232, Ethernet etc., but also wireless communication systems such as Bluetooth etc. According to the invention, a complex network having several warning lamps and/or the further or central component and/or the central detection unit and possibly computers, mobiles, PDAs or the like can be implemented which provide for the indication of the operating states of the most varied warning lamps.

In principle, a warning lamp of the warning light device according to the invention can comprise, apart from at least one light unit, also further units such as, e.g., acoustical units or modules having a sensor etc. Their operating states or signals can be advantageously treated or transmitted and possibly displayed like the operating states of the light units in accordance with the statements made above. By this means, further functions of the warning lamps can be advantageously implemented.

With respect to the invention, it is of essential significance that the warning light device or, respectively, the warning lamp network which can be implemented in accordance with the invention is realized in addition to or in parallel with/separately to any possibly existing networking of the technical units to be monitored, particularly production and/or machine tools, and/or of the internal, i.e. control system or bus system or network of the machine. This provides for a flexible and independent use of the invention without having to be matched or adapted to the numerous different networks or bus systems of the production machines etc. which are in some cases present in a production hall.

ILLUSTRATIVE EMBODIMENT

Figure 2:
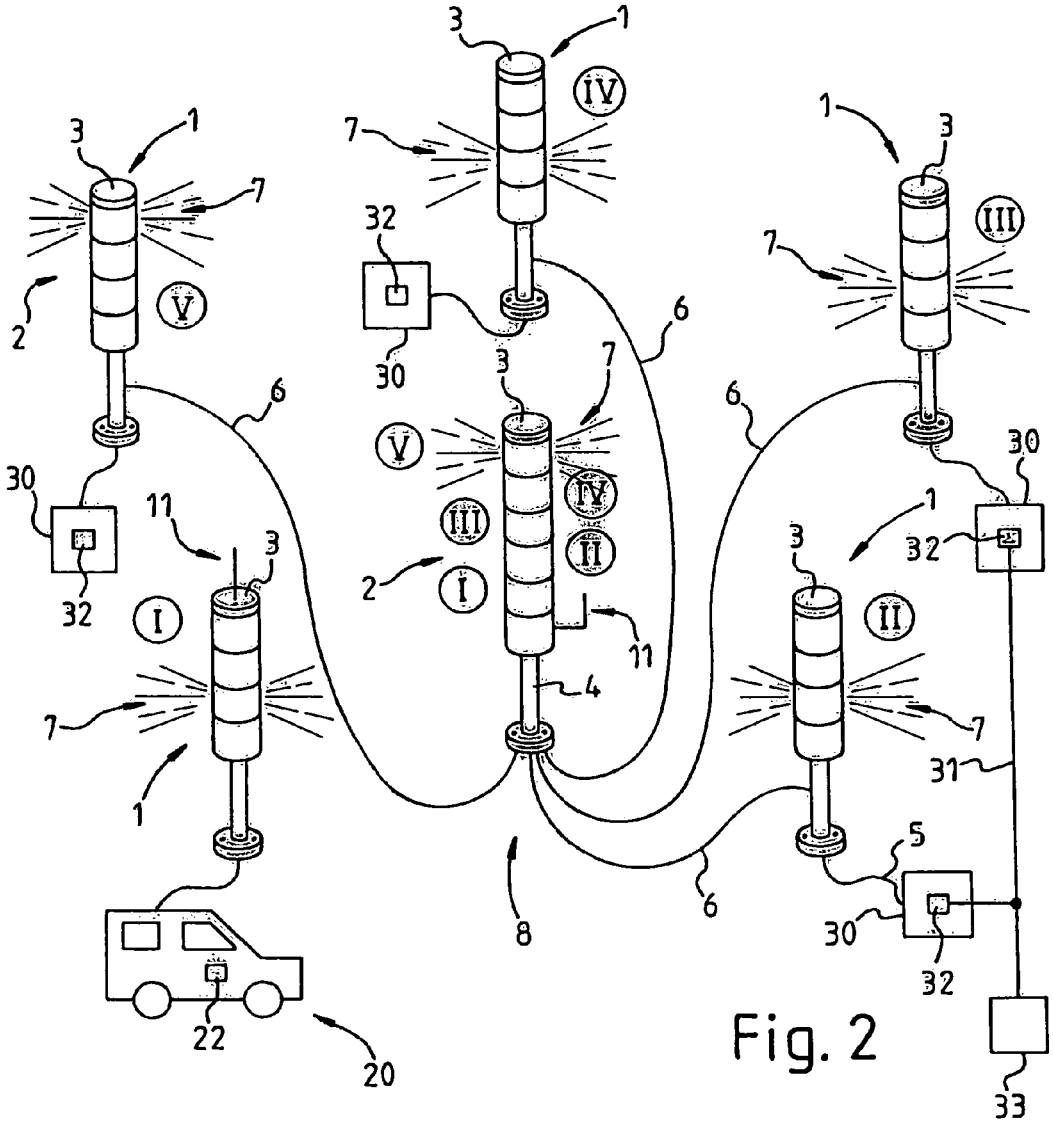
Figure 3:
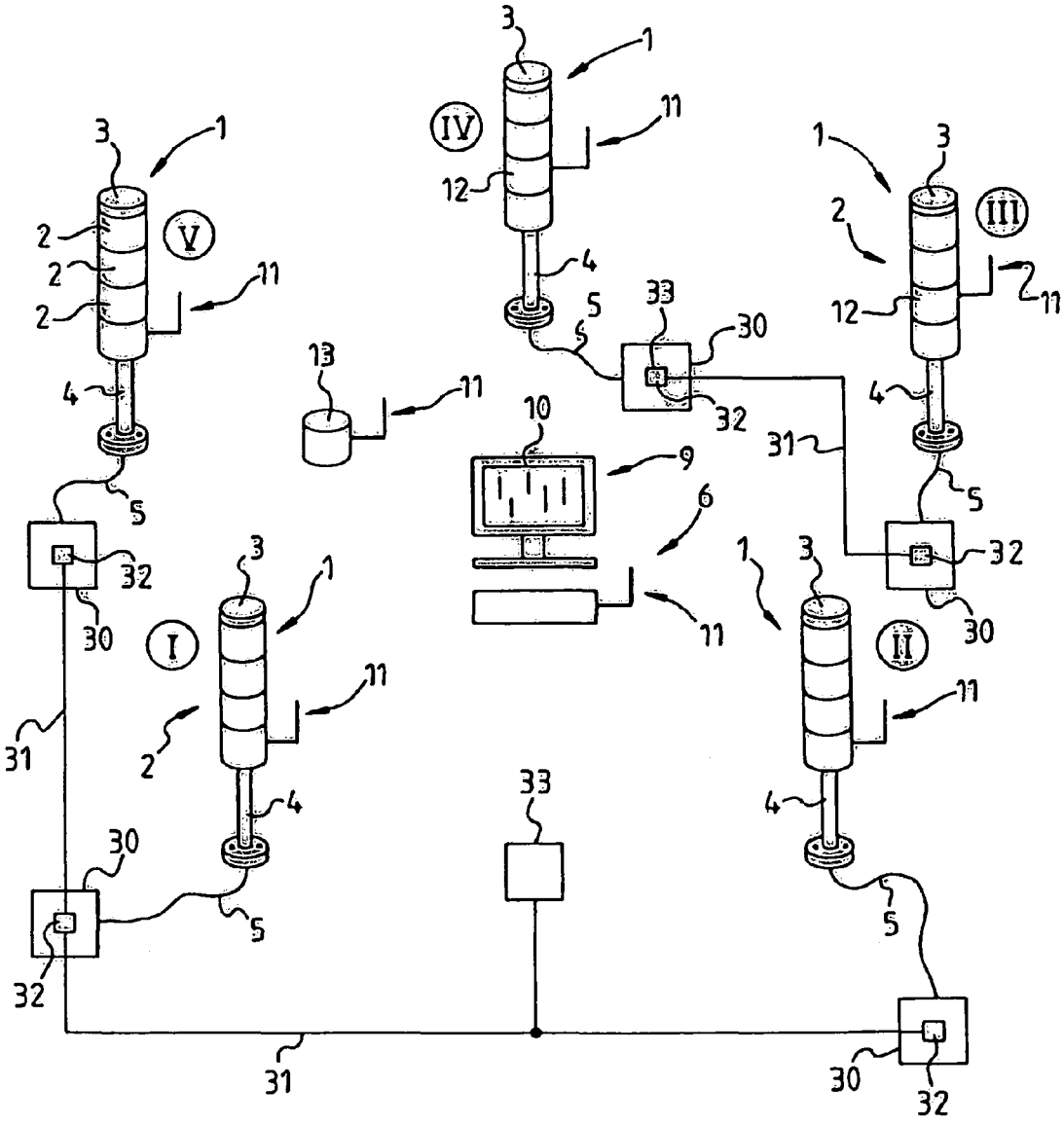

An illustrative embodiment of the invention is shown in the drawing and will be explained in greater detail in the text which follows, referring to the figures in which, in detail:

FIG. 1 shows a diagrammatically represented first embodiment of a warning light device according to the invention with three signaling columns, FIG. 2 shows a diagrammatically represented second embodiment of a warning light device according to the invention with five warning lamps and one central warning lamp, and FIG. 3 shows a diagrammatic representation of a third embodiment of a warning light device according to the invention with five warning lamps and one central computer monitoring system.

DETAILED DESCRIPTION OF THE INVENTION INCLUDING BEST MODE

FIG. 1 shows three warning lamps as signaling columns 1 having in each case alternating modules 2, one of the signaling columns being wirelessly connected to one of the other two signaling columns 1 by means of antennas 11. The signaling columns 1 are closed at the top by means of a cover 3. At the technical unit shown only very diagrammatically, or the technical unit to be monitored, respectively, such as a machine tool 30 or the like, the signaling columns 1 are in each case mounted with a base 4. The operating states of the technical unit 30, not shown in greater detail, are supplied to the signaling column 1 via a cable 5. In this arrangement, the communication between the technical unit 30 to be monitored and the signaling column 1 (not shown in greater detail) preferably occurs in the manner hitherto normally used by means of a controller 32 of the machine 30. However, an addressed transmission of the respective operating states for advantageously addressed alternating modules 2 can also be implemented. This variant is of special advantage especially when an internal bus system is used inside the signaling column 1.

The two units or machines 30 to be monitored of the front signaling column are electrically connected or networked together, respectively, for example, by means of a machine connection 31. The third, i.e. rear signaling column 1 monitors a single machine 30 which is not networked with the other machines 30 and may be constructed as a mobile machine or vehicle.

According to the invention, the signaling columns 1 are thus separately networked or connected to one another, respectively, in parallel with the machines 30 in order to be able to exchange data or control signals, respectively.

In addition, the warning light device according to FIG. 1 has a connection 6 for the data or signal transmission between two of the warning lamps or signaling columns 1 according to the invention. In the illustrative embodiment shown, the individual light units or alternating modules 2 are connected to one another with in each case one electrical cable, or the connection 6, respectively.

Furthermore, the illustrative embodiment according to FIG. 1 shows that the lowermost light unit or the lowermost alternating module 2, respectively, of the left-hand front warning lamp or signaling column 1, respectively, and the lowermost alternating module 2 of the right-hand front warning lamp or signaling column 1, respectively, is illuminated and sends out light 7. Correspondingly, the state shown relates to a copying of the operating states of the first signaling column 1 with the operating state of the second signaling column 1. Without any more detailed representation, an advantageous selecting device can be provided in this context in order to operate the respective signaling column 1, e.g., in a first operating mode by means of the cable 5 for representing the operating state of the technical unit to be monitored, such as the machine or machine tool or the like, or, in a second operating mode, to operate it by means of the connection 6 or by means of the wireless connection via the antennas 11 for representing the operating state of the other one or second warning lamp or signaling column 1, respectively (as shown by way of example in FIG. 1).

FIG. 2 diagrammatically shows a further or second warning light device according to the invention, a total of five signaling columns 1 being provided. Four of these are in each case advantageously connected via a cable 5 to the corresponding technical unit 20, 30 to be monitored such as a machine tool 30 or the like or, respectively, its own controller 32. According to the invention, a signaling column 1 is wirelessly connected to the central signaling column 8 by means of antennas 11. The most varied technical units are the most varied machines 20, 30 which transmit their respective operating states in each case to the respective signaling column 1 via the corresponding cable 5. Two of the machines 30 or their controller 32, respectively, are networked or connected to one another by means of a machine connection 31 and two of the machines 30 are not networked to the other ones. In addition, one of the machines 30 in the example shown is a vehicle 20 such as, e.g., a transportation tow motor or the like which also has its own electronic controller 22 or internal bus system.

Apart from the five signaling columns 1, in each case labeled with Roman numerals, a central signaling column 8 or central signaling column 8 is provided which, in addition to a cover 3 or a base 4 having a radio antenna 11, comprises a total of five alternating modules 2 in this case.

The Roman numerals shown in FIG. 2 next to the alternating modules 2 are only intended to illustrate the respective correlation of the respective alternating module 2 of the central signaling column 8 with the respective signaling column 1 with the corresponding Roman numeral.

In the illustrative embodiment according to FIG. 2, the central signaling column 8 comprises, for example, five red alternating modules 2 which, e.g., are only illuminated or send out light 7 in the case where the red light unit 2 or the red alternating module 2 of the in each case associated signaling column 1 is also illuminated. By way of example, it is assumed that the in each case topmost alternating module 2 of a signaling column 1 is the red alternating module 2 which indicates a particularly critical operating state of the technical unit 20, 30 to be monitored in each case.

FIG. 2 then shows that the signaling column 1 with the Roman numeral V is in such an operating state that the topmost alternating module 2 is emitting light 7. According to the invention, the central signaling column 8 correspondingly indicates an operating state, the corresponding alternating module 2 having the Roman numeral V, that is to say the topmost alternating module 2 in the example shown, emitting light 7 or red light 7, respectively. An operating person within visual range of the central signaling column 8 can thus see in a very simple manner that the signaling column 1 having the numeral V which, in some cases, is positioned very far away, e.g. one hundred meters or more or in another building, from the central signaling column 8 indicates a critical state of the unit to be monitored.

At the same time, FIG. 2 shows that the warning lamps or signaling columns 1 having the Roman numerals I to IV are in each case in an operating state, the lowermost, for example the green alternating module 2, emitting light 7. Correspondingly, the light units or alternating modules 2 of the central signaling column 8 which are correspondingly associated with the signaling columns 1 having the Roman numerals I to IV are not illuminated.

The second illustrative embodiment according to FIG. 2 also has an electrical cable connection 6 and a wireless connection via the antenna 11. In this arrangement, however, the connection 6 is implemented, for example, between the base 4 of the central signaling column 8 and the bases 4 of the signaling columns 1.

The central signaling column 8 can be constructed and operated as a so-called master and the other warning lamps or signaling columns 1 can be constructed and operated as so-called slaves.

FIG. 3 shows a further, third illustrative embodiment according to the invention, five signaling columns 1 again being identified by Roman numerals I to V. In addition, a central computer 9 is provided which comprises a screen 10 for displaying the operating states of the signaling columns 1.

The illustrative embodiment shown is an electrical connection according to the invention which is effected completely wirelessly or via radio, respectively, by means of antennas 11. For example, the bases 4 of the signaling columns 1 having Roman numerals I, II and V in each case comprise the antenna 11. In contrast, the signaling columns having the Roman numerals III and IV in each case comprise a radio module 12, constructed as alternating module, having the antenna 11.

In contrast, the machines 30 to be monitored form two networks constructed separately from the warning lamp network, which correspondingly communicate via cable connections 31. In this arrangement, one of the two machine networks comprises a machine center 33 which centrally controls three of the machines 30, involving the internal machine controllers 32.

The signaling columns 1 according to FIG. 3 have in common that in each case three light units or alternating modules 2 are provided for indicating correspondingly different operating states of technical units, not shown in greater detail, such as machine tools or the like.

In addition, a so-called router 13 having an antenna 11 can also be provided which, for example, can be arranged between the computer 9 and especially far distant signaling columns 1 in order to advantageously bridge longer radio links. If necessary, several signaling columns 1 for which the router 13 transmits corresponding radio signals to the computer 9 can be allocated to one router 13.

For example, the antenna 11 of the computer 9 can be constructed as separate component which, in particular, can be connected to the computer 9 by means of a plug-in connection such as a USB plug or the like. An advantageous software in the computer 9 can be used for advantageously achieving the central detection, monitoring and representation of the warning lamps 1, 8 or of the existing components, respectively, i.e. the network topology, or current or past operating states, respectively. By this means, a statistical evaluation and visualization especially of chronologically stored operating states over a desired period of time such as one month, year etc. can also be realized for example by means of a data memory of the computer 9.

In principle, an advantageous bidirectional communication between the warning lamps 1, light units 2, central signaling columns 8, routers 13, computers 9 etc. can be provided in all examples of the invention shown or described.

It is especially when radio modules 12 or radio antennas 11 are used for the wireless connection 6 of the signaling columns 1 to the computer 9 or to one another between the warning lamps 1 that a codification or addressing of the signaling columns 1 or light units or alternating modules 2 is of special advantage. In this context, an internal bus addressing or internal bus system can be advantageously provided inside the signaling column 1 and/or inside the warning light device according to the invention. This internal bus system can be implemented largely independently of the different technical units to be monitored such as machine tools etc.

In the illustrative embodiment according to FIG. 3, for example, the central computer 9 can receive both data or operating states, respectively, of a signaling column 1, for example having the Roman numeral I and, if necessary, forward these to another signaling column 1, for example Roman numeral II so that the signaling column 1 having the Roman numeral II now indicates or represents the operating state of signaling column 1 having Roman numeral I for a special case of application. Correspondingly, according to the invention, there is a connection between the signaling columns 1 of the warning lamp system shown in which the computer is integrated. Correspondingly, the router 13 can also be used without, for example, the central computer 9 being especially involved in this communication.

In general, the warning light device, apart from the components shown, can transmit, mainly by using wireless connections or antennas 11, respectively, one or the operating states of the warning lamps 1, 8 to a separate additional device such as, for example, a mobile, a mobile PDA, a portable computer or Notebook or the like. When an advantageous wireless communication is used, it is possible to access, for example, wireless transmission systems such as GSM, UMTS, WLAN, BLUETOOTH, ZigBee or others which are already known.

According to the invention, it is of advantage in principle that conventional signaling columns 1 which are/were essentially constructed of alternating modules can be retrofitted or upgraded without great expenditure especially when an alternating module 12 is used which is constructed as radio module 12, so that several signaling columns 1, 8 form an advantageous warning lamp network. In this arrangement, the warning lamp network does not need to be adapted to the internal communication of the unit 20, 30 to be monitored. In practice, several different internal machine communication systems can frequently be found networked or not networked or only partially networked inside a production site or machine shop etc. According to the invention, it is now possible to set up a separate or parallel communication or networking of the warning lamps/signaling columns 1, 8 without great expenditure (without special software and hardware). This warning lamp network can be implemented within a few minutes, e.g. by installing the radio module 12 and downloading software to a computer 9.

In the prior art according to DE 101 24 132, in contrast, a communication matched or adapted to the communication of the machines must be developed and installed for which purpose interfaces must be developed which are generally costly to implement. Accordingly, the setting up of such a network structure requires a very great effort in development, hardware and software and also time which is also economically disadvantageous.

LIST OF REFERENCE DESIGNATIONS

1 Signaling column
2 Alternating module
3 Cover
4 Base
5 Cable
6 Connection
7 Light
8 Central signaling column
9 Computer
10 Screen
11 Antenna
12 Radio module
13 Router
20 Vehicle
22 Controller
30 Machine
31 Connection
32 Controller
33 Machine center

What is claimed is:

1. A warning light device comprising:

a first warning lamp with at least one first light unit having at least one first lighting element, or a first alternating module, for visually indicating at least one operating state, of a technical unit having an electronic control device, an indicating unit for visually indicating at least one operating state, of the first warning lamp, at least one electronic warning lamp connection for transmitting data and/or control signals between the first warning lamp and the indicating unit wherein the indicating unit is a signaling column or a second alternating module.

2. The warning light device according to claim 1, further comprising a second warning lamp with at least one second lighting element for visually indicating at least one operating state of a second technical unit wherein the indicating unit provides for visually indicating at least one operating state, of the first and the second warning lamp.

3. The warning light device according to claim 2 wherein at least one of the technical units to be monitored has at least one electronic control device and/or at least one electronic unit connection for transmitting data and/or control signals between the technical units.

4. The warning light device according to claim 3 wherein the electronic warning lamp connection is separate from electronic control devices of the technical units and/or from the electronic unit connection.

5. The warning light device according to claim 3 wherein the electronic warning lamp connection has at least one transmitter and/or receiver for a wireless control signal and/or data transmission.

6. The warning light device according to claim 1 further comprising a third warning lamp with at least one third light unit having at least one third lighting element for visually indicating at least one operating state of a third technical unit wherein the indicating unit also indicates the operating state of the first and the second and the third warning lamp.

7. The warning light device according to claim 1 wherein the indicating unit is a signaling column having several alternating modules with at least one module lighting element.

8. The warning light device according to claim 7 wherein the number of alternating modules providing a lighting element of the signaling column corresponds to the number of light units of the first and/or second and/or of the third warning lamp.

9. The warning light device according to claim 7 wherein the number of alternating modules of the signaling column corresponds to the number of warning lamps.

10. The warning light device according to claim 1 further comprising at least one address and/or one code for each of the warning lamps and/or of the light units and/or the indicating unit.

11. The warning light device according to claim 1 further comprising at least one electrical data memory for storing the operating states of at least one of the warning lamps and/or of the light units and/or the indicating unit.

12. The warning light device according to claim 1 further comprising at least one display unit for visually indicating the operating states of at least one of the warning lamps and/or of the light units and/or the indicating unit.

13. The warning light device according to claim 1 wherein the at least one first light unit for indicating at least one operating state also indicates a different operating state from a plurality of different operating states.

14. The warning light device of claim 1 wherein said second alternating module has at least one second lighting element.

15. A warning light system comprising:

(a) a warning lamp having at least one first light unit with at least one lighting element or an alternating module, for visually indicating at least one operating state of a technical unit having an electronic control device;

(b) an indicating unit or a signaling column for indicating at least one operating state from a plurality of different operating states; and (c) at least one electronic warning lamp connector for transmitting data and/or control signals between the warning lamp and the indicating unit.

16. The warning light system of claim 15 wherein said indicating unit includes an alternating module.

17. A warning light apparatus comprising:

(a) a warning lamp having at least one first light unit or a first alternating module for visually indicating at least one operating state of a technical unit having an electronic control device;

(b) an indicating unit having a lamp, a signalling column or a second alternating module for visually indicating at least one operating state of the first warning lamp; and (c) at least one electronic warning lamp connection for transmitting data and/or control signals between the warning lamp and the indicating unit.

* * * * *